US008550904B2

(12) United States Patent
Kyte et al.

(10) Patent No.: US 8,550,904 B2
(45) Date of Patent: Oct. 8, 2013

(54) GAMING SYSTEM AND METHOD COMPRISING ASYNCHRONOUS TRIGGER OF THE N-TH UNIT PRIZE

(75) Inventors: Robert L. Kyte, Chicago, IL (US); Chris Parrinello, Rolling Meadows, IL (US); Craig Sylla, Round Lake, IL (US); Allon G. Englman, Chicago, IL (US); Michael W. Mastropietro, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 0 days.

(21) Appl. No.: 13/472,261

(22) Filed: May 15, 2012

(65) Prior Publication Data

US 2012/0289325 A1 Nov. 15, 2012

Related U.S. Application Data

(63) Continuation-in-part of application No. 12/672,977, filed as application No. PCT/US2008/010182 on Aug. 28, 2008, now Pat. No. 8,251,805.

(60) Provisional application No. 60/966,570, filed on Aug. 29, 2007.

(51) Int. Cl.
*G07F 17/32* (2006.01)

(52) U.S. Cl.
USPC ..... 463/25; 463/16; 463/20; 463/29

(58) Field of Classification Search
USPC ..... 463/16, 20, 25, 29
See application file for complete search history.

(56) References Cited

U.S. PATENT DOCUMENTS

| | | | | |
|---|---|---|---|---|
| 5,280,909 | A | 1/1994 | Tracey | 273/138 A |
| 6,416,409 | B1 | 7/2002 | Jordan | 463/27 |
| 6,517,433 | B2 | 2/2003 | Loose et al. | 463/20 |
| 6,835,134 | B2 | 12/2004 | Poole et al. | 463/25 |

(Continued)

FOREIGN PATENT DOCUMENTS

| | | |
|---|---|---|
| JP | 2007-517535 | 7/2007 |
| WO | 2005/099425 | 10/2005 |
| WO | 2006/121663 | 11/2006 |

OTHER PUBLICATIONS

PCT International Search Report for International Application No. PCT/US2008/010182 dated Nov. 10, 2008 (2 pages).

(Continued)

*Primary Examiner* — Omkar Deodhar
(74) *Attorney, Agent, or Firm* — Nixon Peabody LLP

(57) ABSTRACT

A wagering game system includes a game controller configured to determine an eligibility threshold trigger for an n-th unit prize and add, for each connected wagering game machine, a set of discrete eligibility units to a discrete eligibility units counter responsive to an input wager at the respective wagering game machine. The game controller evaluates a subset of the set of discrete eligibility units at a selected wagering game machine against the eligibility threshold trigger to determine if the eligibility threshold trigger is satisfied by that wagering game machine and to subtract the subset of the discrete eligibility units from the discrete eligibility units counter at the selected wagering game machine. The game controller evaluates the subset of discrete eligibility units against the eligibility threshold trigger and awards the n-th unit prize if the discrete eligibility units in the subset of discrete eligibility units satisfies the eligibility threshold trigger.

20 Claims, 11 Drawing Sheets

(56) References Cited

U.S. PATENT DOCUMENTS

| | | | | |
|---|---|---|---|---|
| 7,662,040 | B2 | 2/2010 | Englman et al. | 463/42 |
| 7,780,531 | B2 | 8/2010 | Englman et al. | 463/42 |
| 7,874,915 | B2 | 1/2011 | Caspers et al. | 463/27 |
| 7,931,530 | B2 | 4/2011 | Anderson et al. | 463/20 |
| 2005/0054429 | A1 | 3/2005 | Baerlocher et al. | 463/25 |
| 2006/0135243 | A1 | 6/2006 | Englman et al. | 463/16 |
| 2006/0172804 | A1 * | 8/2006 | Acres et al. | 463/42 |
| 2008/0045341 | A1 | 2/2008 | Englman | 463/42 |
| 2009/0247277 | A1 | 10/2009 | Caspers et al. | 463/20 |
| 2009/0247292 | A1 | 10/2009 | Caspers et al. | 463/27 |
| 2010/0016060 | A1 | 1/2010 | Jaffe | 463/20 |
| 2010/0069160 | A1 | 3/2010 | Barrett et al. | 463/46 |
| 2010/0105470 | A1 | 4/2010 | Englman | 463/27 |
| 2010/0234099 | A1 | 9/2010 | Rasmussen et al. | 463/29 |
| 2010/0267442 | A1 | 10/2010 | Englman et al. | 463/20 |
| 2010/0304830 | A1 | 12/2010 | Englman et al. | 463/17 |
| 2011/0130191 | A1 | 6/2011 | Englman et al. | 463/20 |
| 2011/0165938 | A1 | 7/2011 | Anderson et al. | 463/25 |
| 2011/0201410 | A1 | 8/2011 | Englman et al. | 463/25 |

OTHER PUBLICATIONS

PCT International Written Opinion for International Application No. PCT/US2008/010182 dated Nov. 10, 2008 (5 pages).

* cited by examiner

500

| 502 Weighting | 504 Free Spins Increment Amount |
|---|---|
| 9 | 0 |
| 1 | 1 |

FIG. 5

GAMING SYSTEM AND METHOD COMPRISING ASYNCHRONOUS TRIGGER OF THE N-TH UNIT PRIZE

CROSS-REFERENCE TO RELATED APPLICATION

This application is a continuation-in-part of U.S. patent application Ser. No. 12/672,977, entitled "Gaming System Having Improved Progressive Jackpots", filed Feb. 10, 2010, which is a U.S. national stage of International Application No. PCT/US2008/010182, titled "Gaming System Having Improved Progressive Jackpots" and filed Aug. 28, 2008, which claims priority to U.S. Provisional Patent Application Ser. No. 60/966,570, titled "Gaming System Having Improved Progressive Jackpots" and filed on Aug. 29, 2007, each application is incorporated herein by reference in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a gaming system having passive player participation in secondary wagering games.

BACKGROUND OF THE INVENTION

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options.

N-th coin progressives are conventionally implemented so that the determination of whether or not the n-th coin was contributed to the threshold is made at the time the wager was committed at the EGM. It is conventionally required that any progressive contribution be paid to the EGM before the wager/spin is completed at the EGM.

SUMMARY OF THE INVENTION

In at least one aspect, the present concepts include a wagering game system including a game controller, a physical memory operatively coupled to the game controller and a wagering game machine, comprising a display device, communicatively coupled to the game controller. The game controller is operatively configured to perform acts including determining a mystery threshold trigger level for an n-th unit prize and setting a threshold trigger level counter to an initial value, discretizing an input wager into a plurality of discrete eligibility units, and adding the plurality of discrete eligibility units to a discrete eligibility units counter for the wagering game machine. The game controller is also operatively configured to perform acts including subtracting periodically a discrete eligibility unit from the discrete eligibility units counter and correspondingly incrementing the threshold trigger level counter, determining whether the discrete eligibility unit used to increment the threshold trigger level counter triggers the n-th unit prize, and triggering the n-th unit prize if the threshold trigger level counter meets or exceeds the threshold trigger level or if the threshold trigger level counter meets or exceeds another predetermined value relative to the threshold trigger level. The game controller is operatively configured to award the n-th unit prize responsive to the act of triggering or, absent such triggering, iteratively performing at least the acts of subtracting and determining until no discrete eligibility units remain in the discrete eligibility units counter.

In at least one other aspect, the present concepts include a method of conducting a wagering game of a wagering game system comprising a plurality of wagering game machines includes the acts of determining a mystery threshold trigger level for the n-th unit prize and setting the threshold trigger level counter to the initial value, discretizing, for each of the plurality of wagering game machines, an input wager into a plurality of discrete eligibility units and adding, for each of the plurality of wagering game machines, the plurality of discrete eligibility units to a discrete eligibility units counter for the respective wagering game machine. The method also includes the acts of subtracting a discrete eligibility unit from a discrete eligibility units counter at a selected one of the plurality of wagering game machines and correspondingly incrementing the threshold trigger level counter and determining whether the discrete eligibility unit used to increment the threshold trigger level counter triggers the n-th unit prize. The method also includes the acts of iteratively selecting, absent triggering of the n-th unit prize, another one of the plurality of wagering game machines and repeating the acts of subtracting, incrementing, and determining, until the n-th unit prize is triggered and awarding the n-th unit prize to a selected one of the plurality of wagering game machines that triggers the n-th unit prize.

In yet another aspect, the present concepts include a wagering game system includes a game controller, a physical memory operatively coupled to the game controller and a wagering game machine communicatively coupled to the game controller, wherein the game controller is operatively configured to perform acts including determining an eligibility threshold trigger for an n-th unit prize, adding a set of discrete eligibility units to a discrete eligibility units counter responsive to an input wager and simultaneously evaluating a subset of the discrete eligibility units against the eligibility threshold trigger to determine if the eligibility threshold trigger is satisfied. The game controller is operatively configured to perform acts including subtracting from the discrete eligibility units counter the subset of discrete eligibility units evaluated by the game controller against the eligibility threshold trigger and awarding the n-th unit prize when a discrete eligibility unit satisfies the eligibility threshold trigger. The subset of the discrete eligibility units comprises a plurality of discrete eligibility units.

In still another aspect, the present concepts include a wagering game system includes a game controller, a physical memory operatively coupled to the game controller, and a plurality of wagering game machines communicatively coupled to the game controller, wherein the game controller is operatively configured to perform acts comprising determining an eligibility threshold trigger for an n-th unit prize and adding, for each of the plurality of wagering game machines, a set of discrete eligibility units to a discrete eligibility units counter responsive to an input wager at the respective one of the plurality of wagering game machines. The game controller is also operatively configured to perform acts comprising evaluating a subset of the set of discrete eligibility units at a selected one of the plurality of wagering game machines against the eligibility threshold trigger to determine if the eligibility threshold trigger is satisfied by the selected one of the plurality of wagering game machines and subtracting the subset of the discrete eligibility units from the discrete eligibility units counter at the selected one of the plurality of wagering game machines. The game controller is also operatively configured to perform acts of evaluating the subset of discrete eligibility units against the eligibility threshold trigger and awarding the n-th unit prize if any of the discrete eligibility units in the subset of discrete eligibility units satisfies the eligibility threshold trigger.

According to yet another aspect of the invention, computer readable storage media is encoded with instructions for directing a gaming system to perform the above method.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

FIG. 5 is a weighted table utilized in incrementing the one or more improved progressive jackpots of FIG. 4;

Figure 1A:
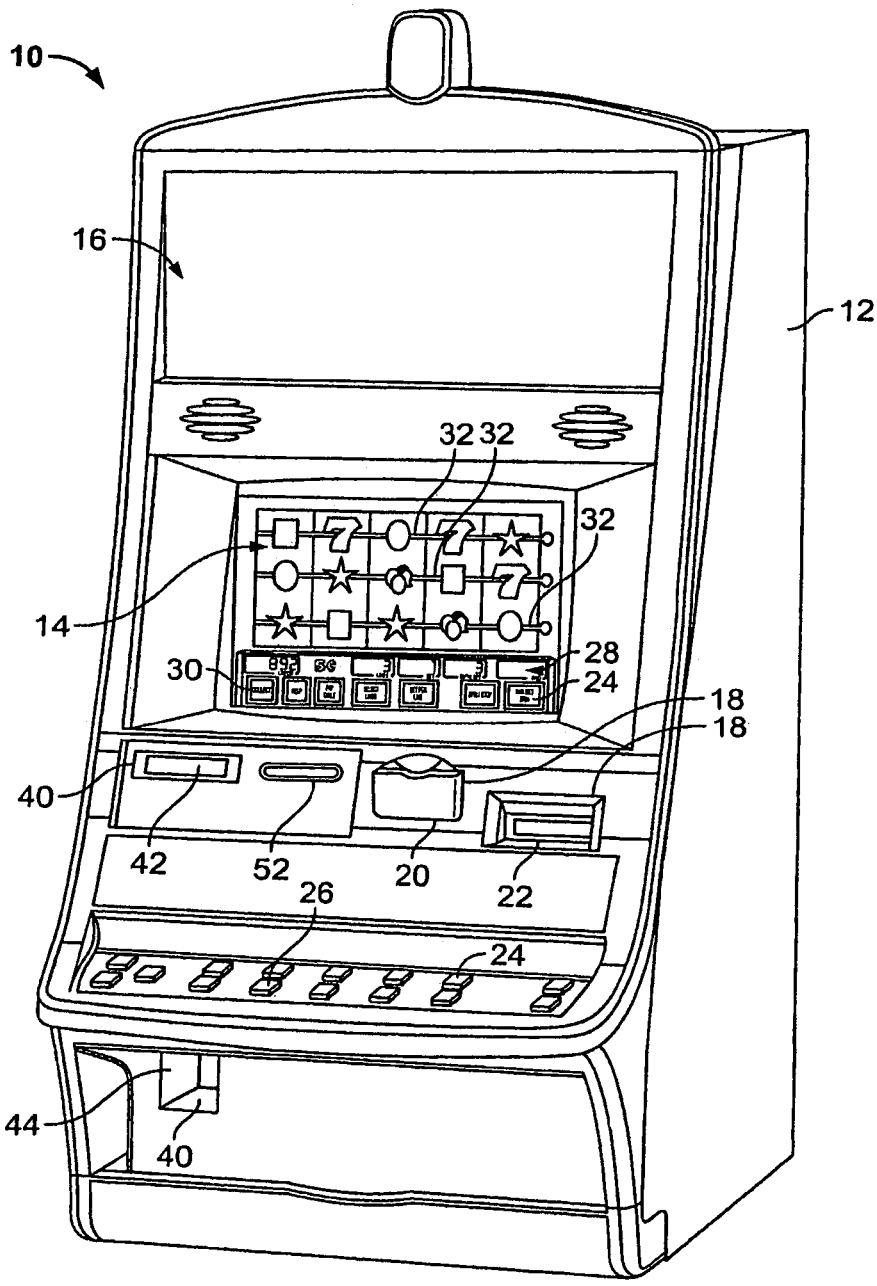
FIG. 1*a* is a perspective view of a free standing gaming machine embodying the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, any other game compatible with a display comprising at least one symbol-bearing reel strip. The gaming machine 10 may also be a hybrid gaming machine integrating both electronic and electromechanical displays.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The gaming terminal 10 may take any suitable form, such as floor-standing models as shown, handheld mobile units, bartop models, workstation-type console models, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433 and Patent Application Publication Nos. US 2010/0069160 and US 2010/0234099, which are incorporated herein by reference in their entireties. PCT Patent Publication WO 2006/121663, U.S. Published Patent Application No. US 2006/0135243, U.S. Published Patent Application No. US 2010/0105470, U.S. Published Patent Application No. US 2011/0130191, U.S. Pat. Nos. 7,931,530 and 7,780,531, all of which are assigned to WMS Gaming Inc., are also incorporated herein by reference in their entirety as if fully set forth herein.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 of the gaming machine 10 may include a number of mechanical reels to display the outcome in visual association with at least one payline 32. Alternatively, the primary display 14 may take the form of a hybrid display incorporating both electromechanical display components, such as reels, with an electronic display, which may include a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
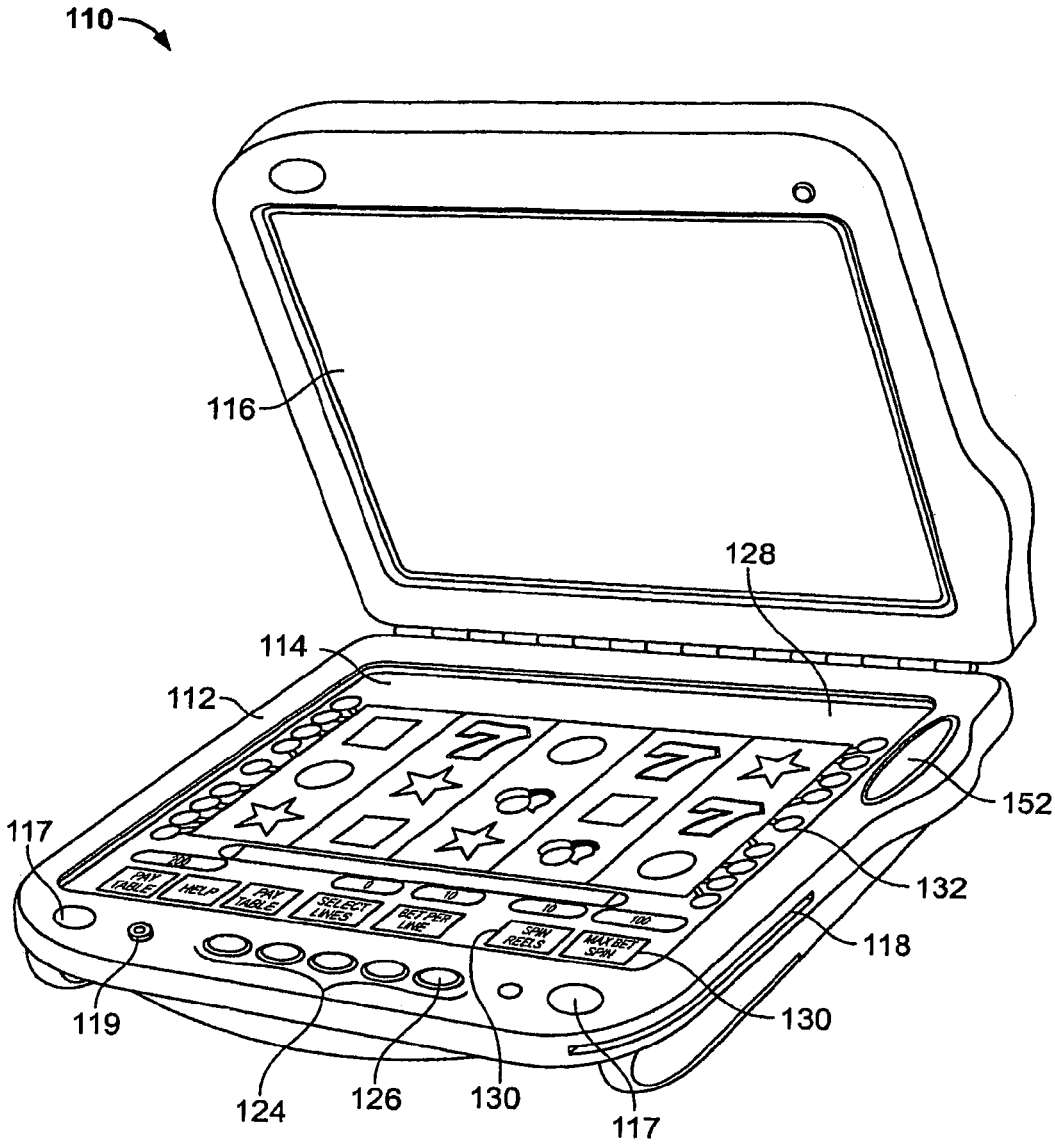
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electromechanical gaming machine configured to play mechanical slots, any other game compatible with a display comprising at least one symbol-bearing reel strip. The handheld gaming machine 110 may also be a hybrid gaming machine integrating both electronic and electromechanical displays. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen 128 mounted to a primary display 114 and/or secondary display 116. In one aspect, the touch screen 128 is matched to a display screen having one or more selectable touch keys 130 selectable by a user's touching of the associated area of the screen using a finger or a tool, such as a stylus pointer. A player enables a desired function either by touching the touch screen 128 at an appropriate touch key 130 or by pressing an appropriate push button 126 on the button panel. The touch keys 130 may be used to implement the same functions as push buttons 126. Alternatively, the push buttons 126 may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably includes a number of mechanical reels to display the outcome in visual association with at least one payline. Alternatively, the primary display 114 may take the form of a hybrid display incorporating both electromechanical display components, such as reels, with an electronic display, which may include a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 118 or an assignment of credits stored on the handheld gaming machine via the player input device 124, e.g. the touch screen keys 130 or push buttons 126) on the handheld gaming machine 110. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1*b*, comprises a biometric sensing device.

Figure 2:
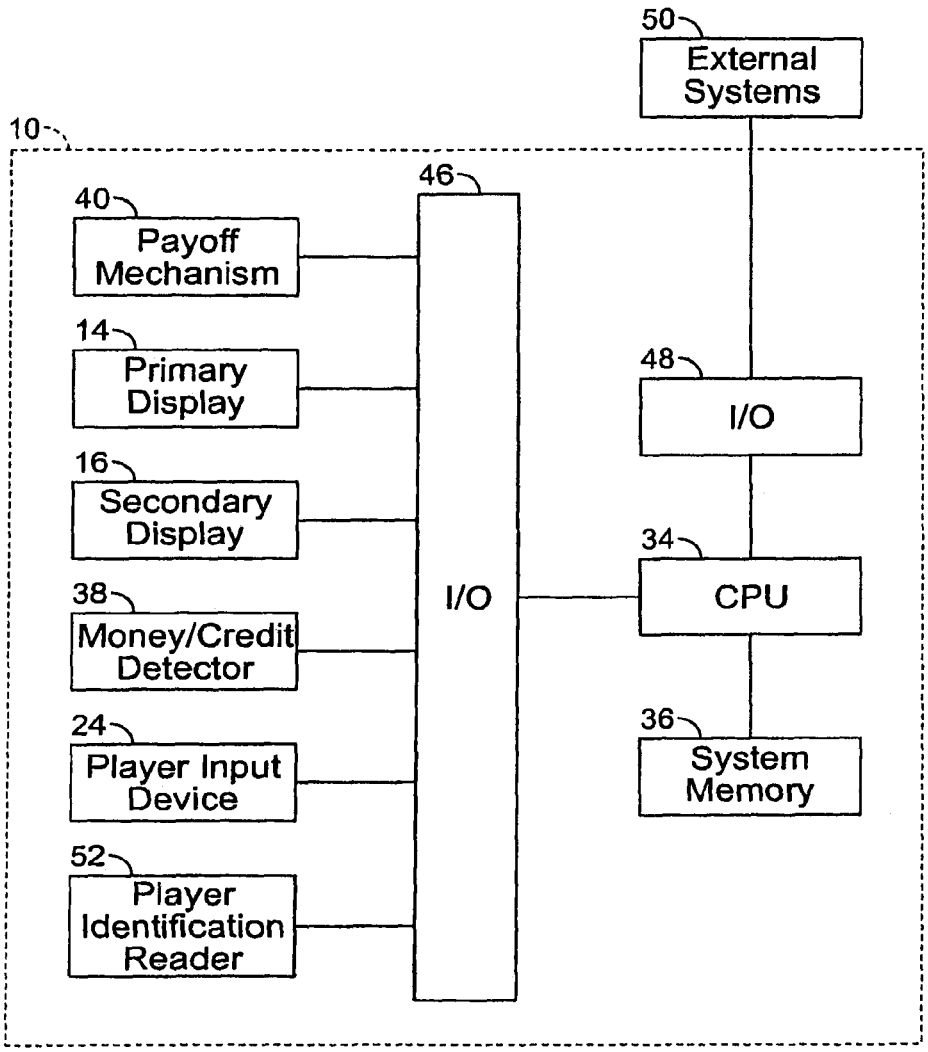
FIG. 2 is a block diagram of a control system suitable for operating the gaming machines of FIGS. 1*a* and 1*b;*

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1*a*, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10,110 may communicate with external systems 50 (in a wired or wireless manner) such that each machine operates as a "thin client," having relatively less functionality, a "thick client," having relatively more functionality, or through any range of functionality there between. As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "thicker client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Figure 3:
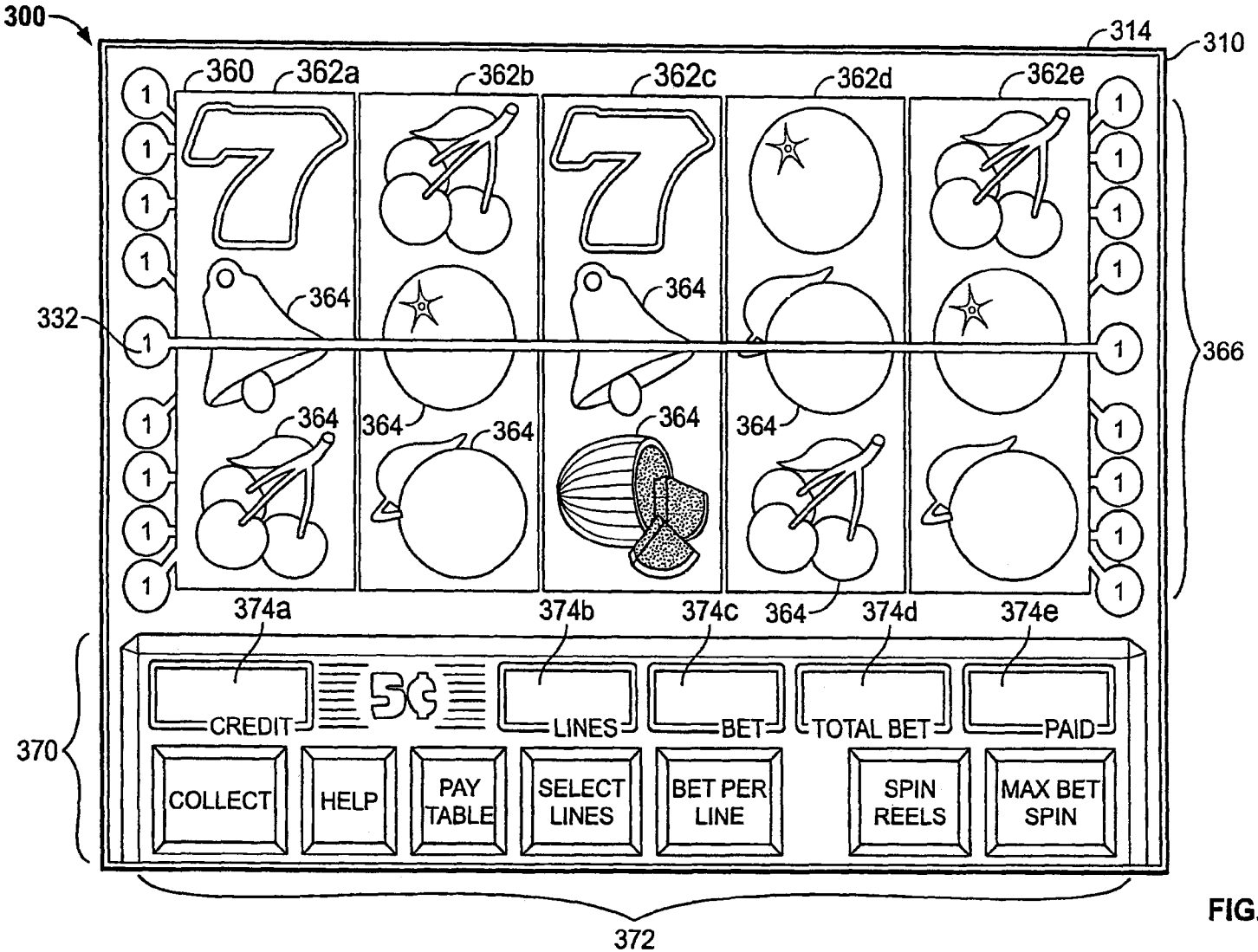
FIG. 3 is a screen shot of a primary wagering game of a gaming system.

Turning now to FIG. 3, a primary display 314 of a gaming device 310 of a gaming system 300 is shown. The primary display 314 may be any form of display such as those described herein with reference to the free standing and handheld gaming devices of FIGS. 1*a* and 1*b*. The primary display 314 includes display of a primary wagering game 360, which in this embodiment is a slot game as shown in FIG. 3. The slot game 360 includes a plurality of reels 362*a,b,c,d,e* which may be either electro-mechanical reels or simulations thereof on the primary display 314. The reels 362*a,b,c,d,e* include a plurality of symbols 364 displayed thereon which vary as the reels 362*a,b,c,d,e* are spun and stopped. The symbols 364 may include any variety of graphical symbols, elements, or representations, including symbols 364 which are associated with one or more themes of the gaming machine or system. The symbols 364 may also include a blank symbol or empty space. As described herein, the symbols 364 landing on the active paylines 332 (the paylines for which a wager has been received) are evaluated for winning combinations. If a winning combination of symbols 364 lands on an active payline 332, a primary award is awarded in accordance with a pay table of the gaming device. The symbols 364 on the reels 362*a,b,c,d,e* form an array 366 or matrix of symbols 364, having a number of rows and columns, which in the embodiment shown is four rows and five columns. In alternate embodiments, the array 366 may have greater or fewer symbols 364, and may take on a variety of different forms having greater or fewer rows and/or columns. The array 366 may even comprise other non-rectangular forms or arrangements of symbols 364.

A control bar 370 appears along the bottom of the display 314 and includes a plurality of input buttons or keys 372 for which inputs are sensed by a touch screen overlying the display 314. Moreover, a plurality of meters 374 are displayed on the control bar 370, including a Credit Meter 374*a*, a Lines Meter 374*b*, a Bet Meter 374*c*, a Total Bet Meter 374*d*, and a Paid Meter 374*e*. The Credit Meter 374*a* displays the number of credits available to a player based upon coin, currency or other value input into the system 300. The Lines Meter 374*b* displays the number of paylines 332 which the player has activated for play. The Bet Meter 374*c* displays the size of the wager that the player is placing (the bet amount in credits) on each activated payline. The Total Bet Meter 374*d* displays the total wager on a single play of the wagering game 360, which is the product of the bet amount in the Bet Meter 374*c* and the number of activated paylines in the Lines Meter 374*b*. The Paid Meter 374*e* displays how many credits, if any, have been awarded to the player as a result of a winning outcome on a single play of the primary wagering game 360. If a winning outcome is achieved, the Paid Meter 374*e* displays the size of the win in credits, after which the credits are transferred to the player's balance in the Credit Meter 374*a*, and the Paid Meter 374*e* is reset to zero for a subsequent play of the primary wagering game 360.

Figure 4:
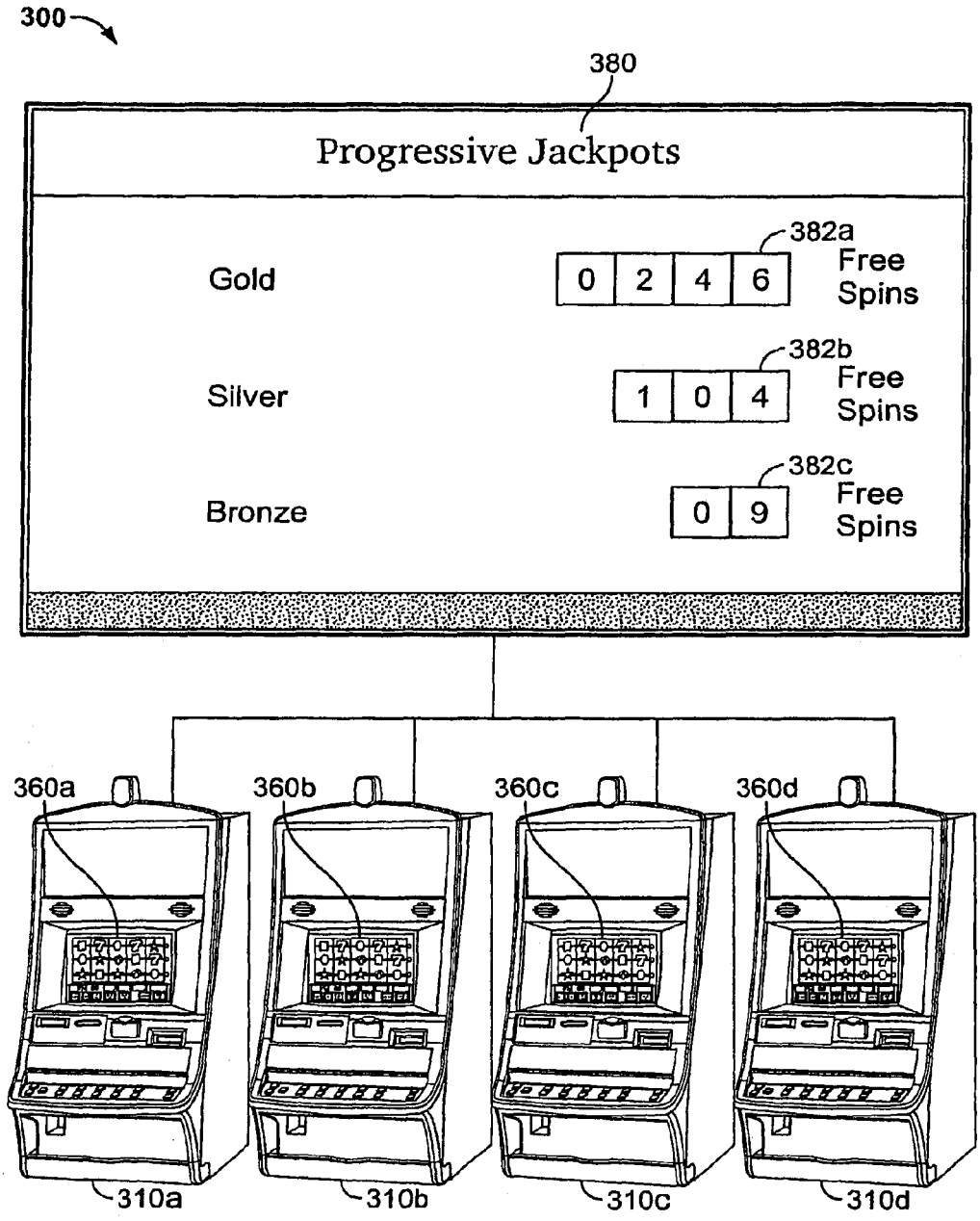
FIG. 4 is a diagram of gaming system including one or more improved progressive jackpots.

Turning to FIG. 4, an alternative view of the gaming system 300 is displayed in which a secondary display 380, such as a plasma display, is mounted above one or more gaming devices 310*a-d* in a casino. The secondary display 380 is in communication with other components of the system 300 such as the various gaming devices 310*a-d*. The secondary display 380 displays one or more progressive jackpots 382*a, b,c*, which in this embodiment are the "Gold", "Silver," and "Bronze" progressive jackpots. The progressive jackpots 382 are available to be awarded to eligible players of one or more primary wagering games 360*a-d* on the gaming devices 310*a-d*, upon the occurrence of one or more triggering events. In an embodiment, a triggering event which causes the award of one or more of the progressive jackpots 380 is a particular outcome in a primary wagering game 360. For example, three or more "Bonus" symbols aligning on an activate payline in a primary wagering game 360 may trigger one or more of the progressive jackpots. In alternative embodiments, other triggering events may be utilized. For example, triggering events may include time-based triggers where a progressive jackpot 382 is awarded after a certain amount of time has elapsed. Moreover, the trigger may be a randomly selected event, such that the progressive jackpots 382 are randomly awarded. In yet other embodiments, triggering events may include a threshold time playing a primary wagering game 360 (time on device), total wagers input meeting a predetermined amount (coin in), accumulation of a certain amount of credits, points, or assets, etc.

In the embodiment shown in FIG. 4, the progressive jackpots 382 are an accumulation of "free spins" of the underlying primary wagering games 360*a-d*. Thus, if a triggering event occurs and a particular progressive jackpot 382 is awarded to a player, the player receives a number of free spins of the primary wagering game 360 equal to the balance of the progressive jackpot awarded. Thus, in FIG. 4, if a triggering event awards the Gold Level progressive to a player, he would receive 246 free spins as indicated by the meters on the secondary display 380. Free spins being stored and awarded through progressive jackpots may be accomplished in various ways, including the methods described in international patent application WO 2005/099425, assigned to WMS Gaming Inc., which is incorporated herein by reference in its entirety as if fully set forth herein. In one method, an expected value of the primary wagering game 360 is utilized in determining the frequency with which one or more of the progressive jackpots 382 are triggered, and the size of the jackpots 382 awarded (the number of free spins provided).

The present invention utilizes a random determination process to increment the progressive jackpots 382 displayed on the secondary display 380. This random determination process ensures that only whole numbers of free spins are displayed, rather than fractional free spin awards. Thus, the system 300 of the present invention utilizes a random number generator to increment the progressive jackpots 382. The display of the progressive jackpots 382 is incremented (if at all) through a determination made from a weighted probability table, an example of which is depicted in FIG. 5.

The random determination is made in accordance with the weighted table 500 shown in FIG. 5, which determines whether or not to increment the progressive jackpot meters 382. The table includes a weighting column 502 and a corresponding free spin increment column 504. Thus, in the embodiment shown, a random number is selected between 1 and 10. If the number selected is 1 through 9, then the progressive jackpots are incremented by an amount of "zero" (i.e., they are not incremented). If 10 is selected, then one or more of the progressive jackpots 382 are incremented by the corresponding 1 free spin. In an embodiment, a random determination is made for each level of the progressive jackpots 382. Thus, on each play of the wagering game 360 (each time a primary wager is input), there is a 90% chance that the progressive meters will not be incremented, and a 10% chance that the progressive meters will be incremented by a whole number amount (1 free spin, for example). This way, the incrementing of the progressive meters avoids fractional or decimal incrementing of the progressive meters. In other embodiments, other weighted tables other than the one shown in FIG. 5 may be used. As can be seen from this configuration, on average, once every 10 spins of the primary wagering game 360, the meters 382 will be incremented by one (1) spin.

In an embodiment, instead of a portion of each primary wager being added to the progressive meters, a larger portion of the primary wager which triggers an incrementing of the progressive meters 382 is taken. For example, in one embodiment the progressive jackpots 382 are configured to be funded by 5% of the primary wagers input into the system 300. In a traditional system, for each $1.00 wagered, $0.05 would be added to the meters on each press of the spin button. In the system 300, according to an embodiment of the present invention, whether or not any portion of the primary wager is added to the progressive jackpots 382 is a function of the random determination made in accordance with the weighted table 500, such as the one in FIG. 5. If the result of the random determination is that the increment amount is zero (the progressive meter will not be incremented), then none of the $1.00 primary wager is apportioned for the progressive jackpots 382, nor are the progressive jackpots 382 incremented. On the other hand, if the result of the random determination is that the meters 382 are to be incremented by one (1) spin, then $0.50 of the primary wager on that spin is apportioned to the progressive meters 382. The apportioned amount ($0.50) of the primary wager is calculated as follows:

$$\text{Apportioned Amount} = \text{Primary Wager.times.Progressive Portion Increment Odds} \qquad \text{##EQU00001##}$$

Thus, the total amount to be apportioned to the progressive jackpots 382 is a function of the amount of the primary wager ($1.00, in the example), the portion of the primary wager allocated to the progressive jackpots (5%, in the example), and the odds of the progressive meters 382 being incremented in accordance with the weighted table such as the one in FIG. 5 (10%, in the example). Thus, for the example shown, where the progressive jackpots 382 are configured to have a 5% allocation of primary wagers, and the odds of the increment occurring are 10%, the apportioned amount is calculated as follows:

$$\text{Apportioned Amount} = (\$1.00).\text{times.}(0.05)(0.10) = \$0.50 \qquad \text{##EQU00002##}$$

Thus, with such an embodiment, the meters 382 are incremented on average once every 10 spins, and when they are incremented, an apportioned amount of $0.50 is added to the meters 382 (based upon primary wagers of $1.00). In this way, instead of 5% of a primary wager being added to the meters on every spin (as would be done with traditional progressive systems), 50% of a primary wager is added every ten spins on average.

In an alternative embodiment, a progressive-increment pool is utilized to receive and store portions of wagers attributable, and used, to increment the progressive jackpots 382. Thus, for each play of a primary wagering game 360 of the system 300, a portion of the primary wager is allocated to a progressive-increment pool. Thus, using the numbers from the example above, five percent (5%) of all primary wagers are apportioned and stored in a progressive-increment pool. On a $1.00 wager, $0.05 is stored in the progressive-increment pool. As before, on each spin a random determination is executed to determine whether an increment amount (if any) should be applied to the progressive jackpot meters 382, in accordance with a weighted table 500 (for example the table in FIG. 5). On average, ten spins will occur before a progressive jackpot 382 is incremented, correlating to an average of ten $0.05 apportionments being collected into the progressive-increment pool (or $0.50 being collected into the progressive-increment pool). When the random determination results in one or more progressive meters being incremented, the amount added to the meters is removed from the progressive-increment pool and placed into a progressive pool. When a progressive jackpot 382 is awarded in response to a triggering event, then a corresponding award (jackpot) is provided from the progressive pool (which has been repeatedly funded from by the progressive-increment pool. In this way, the progressive-increment pool increases with every spin, but is decremented only when a random determination indicates that the progressive meters should be incremented. If the progressive jackpots are free spins, as discussed herein, the progressive-increment pool can be decremented by an amount sufficient to compensate for the expected value of the free spins incremented to the progressive jackpot 382, as explained further herein.

The progressive increment pool may be a single pool or may be subdivided into various accounts or funds corresponding to the various progressive jackpots 382. In an embodiment, a fixed percentage of each primary wager is deducted and allocated to the progressive increment pool (e.g., 5% of all primary wagers). In alternative embodiments, the portion of primary wagers deducted may be a fixed amount ($0.01), a fixed credit amount (10 credits), or determined randomly or in accordance with some formula, table, or algorithm. The progressive increment pool is used to fund the progressive jackpots 382 so that they contain available prizes to be awarded, as described herein.

When a triggering event occurs, one or more of the progressive jackpots 382 is awarded to a player, as described herein. For example, if three "Gold" symbols in the primary wagering game 360 are aligned on an active payline, a player is awarded the Gold level jackpot, which in the example shown in FIG. 4 is 246 spins. Thus, the player would receive 246 free spins (or plays) of the primary wagering game 360 displayed on the gaming device 310 he is playing. Any awards accumulated during those free spins would be awarded to the player and credited to his win meter. In one embodiment, the free spins have been financed by the apportioned amounts, which have been collected and applied to the progressive meters 382. In another embodiment, the free spins are paid for, or financed, by the progressive increment pool. Thus, according to a configuration of the primary wagering game 360, each play of the primary wagering game 360 has an expected award value (based upon the size of the initial wager). The expected progressive-award value to the player for the awarded free spins can be calculated as a function of the number of free spins awarded and the expected value of each free spin. This expected progressive-award value can then be decremented from the progressive increment pool. Thus, when a free spin progressive jackpot 382 is awarded, the progressive increment pool is decremented in an amount sufficient to finance the number of free spins awarded. Other techniques may be used to decrement the progressive increment pool in an appropriate amount for the free-spin award provided.

It should also be understood that the increment method described herein may give the appearance of "jumps" or sudden increases in the progressive meters 382. Traditional progressive jackpot incrementing techniques that use decimals and small portions give the appearance of constantly being incremented due to the constant addition of small portions of each wager to the progressive jackpots. The present invention provides a different experience in that the progressive meters will "jump" when the whole number award is randomly awarded, whereas on many plays of the wagering game, the progressive meters will not move at all (corresponding to the zero award being awarded). Thus, an observer of the progressive meters will see spurts, jumps, and bursts of increases of the balances of the jackpots shown in the progressive meters, rather than a smooth and steady increase of fractional amounts.

Figure 6:
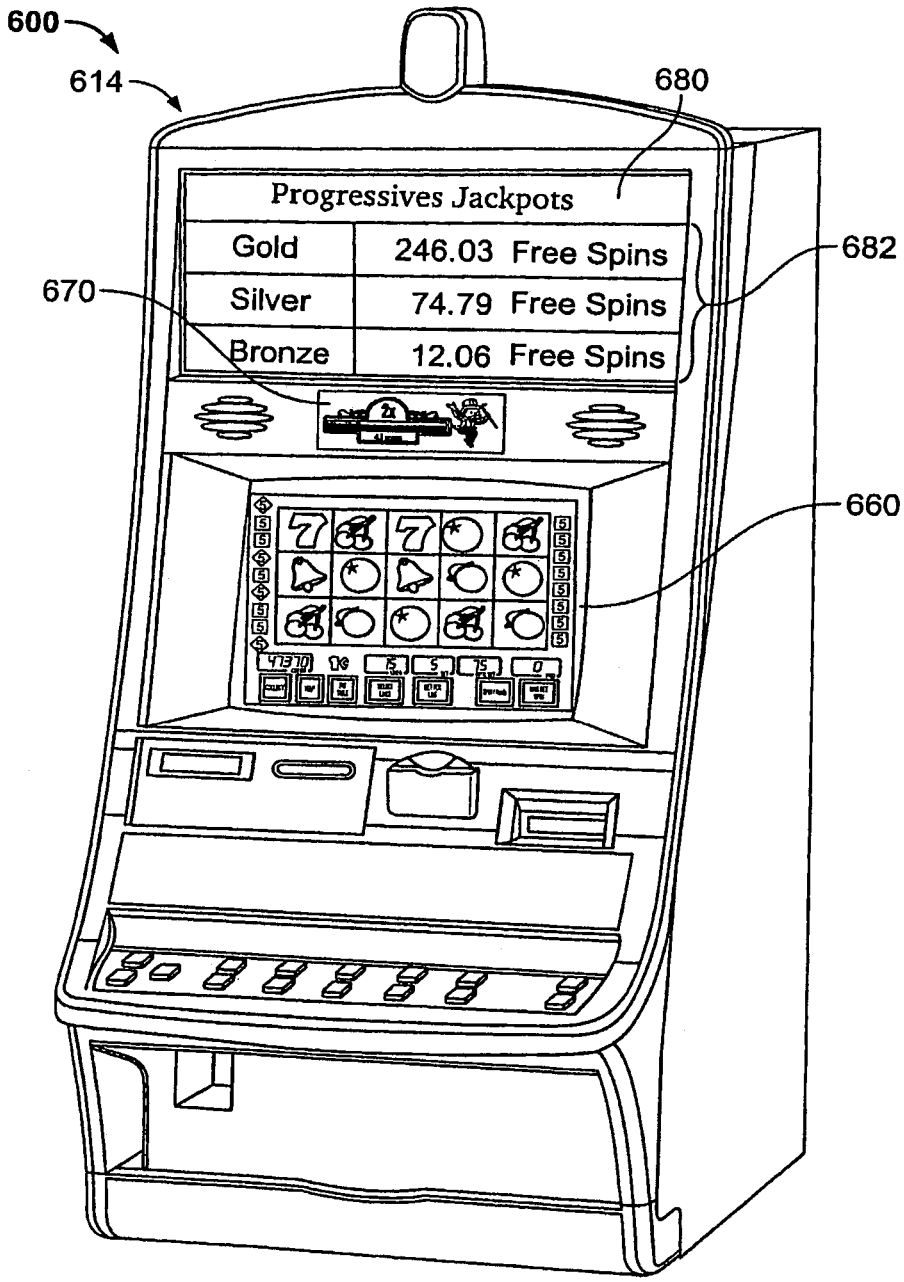
FIG. 6 is a diagram of an alternative embodiment of a gaming system including improved progressive jackpots.

An alternative embodiment of the invention is shown in FIG. 6, wherein a gaming device 614 displays a primary wagering game 660 which includes a time eligibility meter 670, as described in PCT Patent Publication WO 2006/121663, and U.S. Published Patent Application 2006/0135243, both of which are assigned to WMS Gaming Inc., and incorporated herein by reference in their entirety as if full set forth herein. During each play of the wagering game 660, the time eligibility meter 670 is increased in amount corresponding to and dependent upon (i) the size of the primary wager, (ii) the rate of play of the primary wagering game, or both. The time eligibility meter 670 may include a plurality of multiplier levels such that the meter 670 displays both a running time meter clock and a current multiplier level. Moreover, as time eligibility is accumulated in the meter 670, the multiplier levels may increase, and as time eligibility is expended through decrementing of the meter 670, the multiplier levels may decrease, as described therein. The gaming device 614 further includes one or more progressive meters 682 displayed on a secondary display 680 of the gaming device 614. In this embodiment, the progressive meters 682 are incremented as the time eligibility meter 670 decreases or decays. Thus, the incrementing of the progressive jackpots 682 is a function of the decay of the time eligibility meter 670 rather than a portion or function of the primary wager amount.

During play, a fixed amount of time is added to the time eligibility meter 670 for each spin or activation of the primary wagering game 660. For example, the time interval added to the meter 670 may be 7 seconds for each spin. In an embodiment, for each second of decay of the time eligibility counter 670, a base increment amount is added to one or more of the progressive jackpots 682. For example, the wagering game 660 may be configured so that every second of decay of the time eligibility counter 670, 0.01 free spins are added to each of the progressive meters 682. Thus, after 100 seconds of decay of the time eligibility meter 670, one (1) free spin will be incremented to the progressive meters 682.

In an alternative embodiment, the progressive jackpots 682 are incremented less frequently by a larger amount. For example, the jackpots 682 may be incremented by an amount less than or equal to the base increment amount multiplied by the time interval, but such incrementing occurs after the decay of an amount of time equal to the time interval. Thus, in the example described herein, the increment amount is less than or equal to the base increment amount (0.01 free spins) times the time interval (7 seconds), or 0.07 free spins. However, the incrementing occurs only after the time meter 670 decays by an amount equal to the time interval (7 seconds). Thus, for each seven (7) seconds decremented off the time meter 670, the progressive meters 682 are incremented by an amount less than or equal to 0.07 free spins. The examples differ in presentation such that in one example, the meters are incremented 0.01 spins every second, and in the other example the meters are incremented 0.07 spins every seven (7) seconds. In this way, the incrementing of the progressive jackpots 382 is a function of the decay of the time eligibility meter 670.

Figure 7:
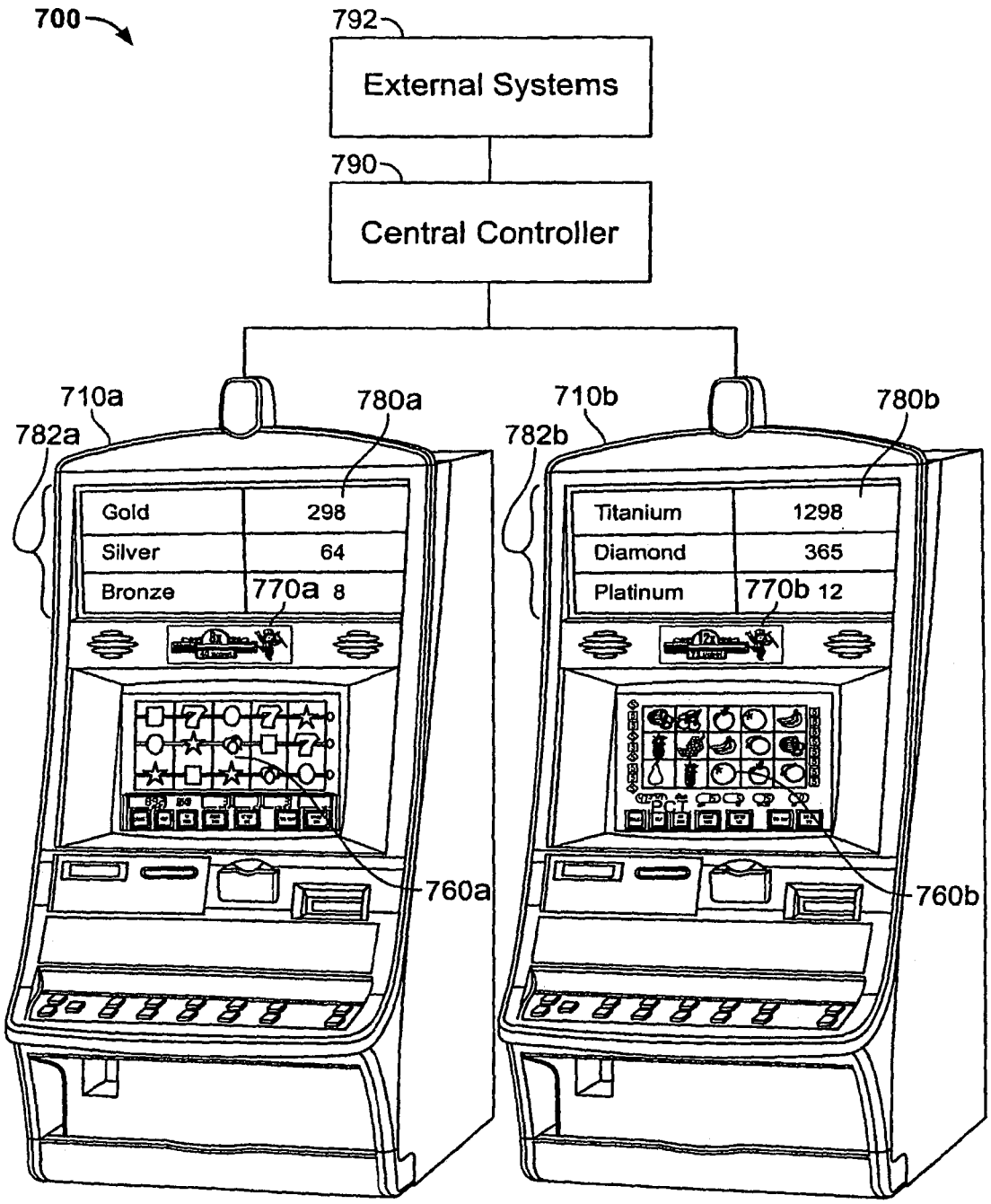
FIG. 7 is a diagram of yet another alternative embodiment of a gaming system including improved progressive jackpots.
Figure 8A:
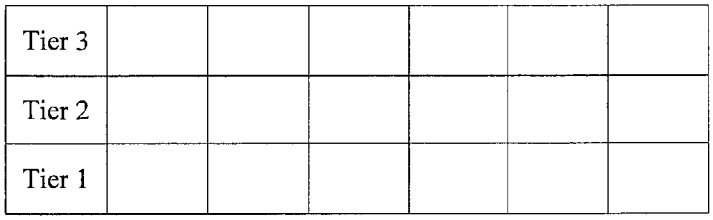
FIGS. 8(*a*)-8(*h*) show, sequentially, operation of discrete eligibility units in accord with at least some aspects of the present concepts.
Figure 8B:
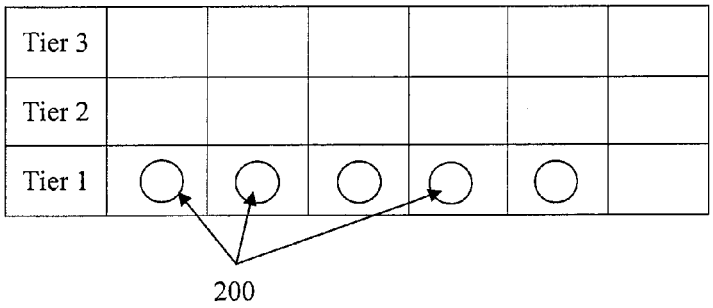
Figure 8C:
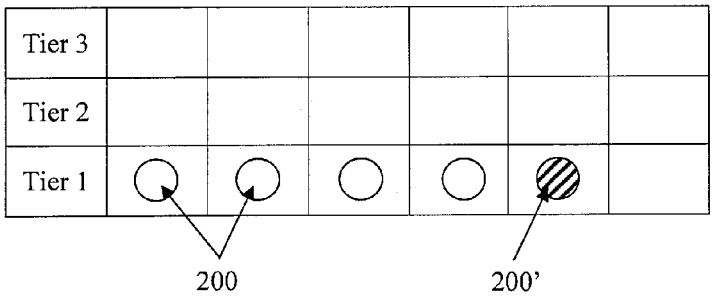
Figure 8D:
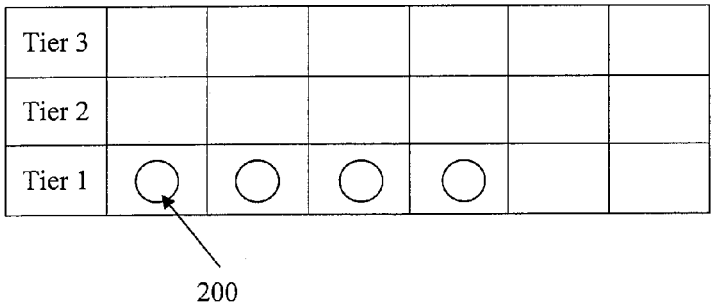
Figure 8E:
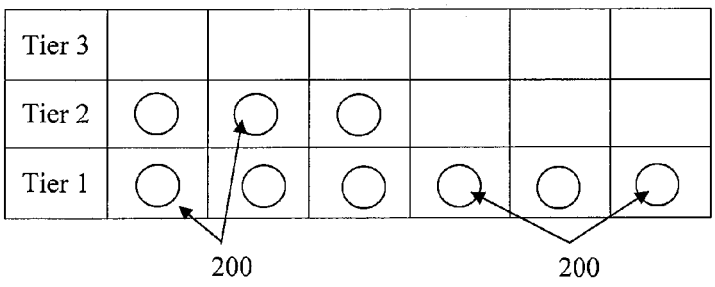
Figure 8F:
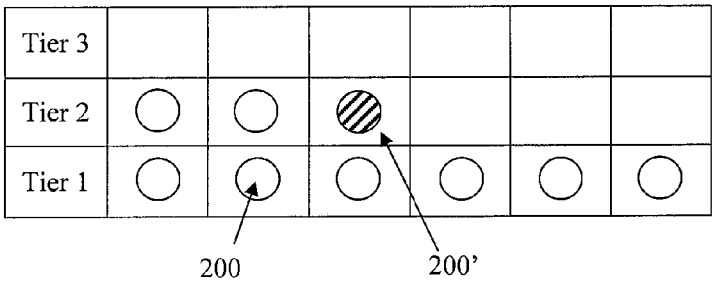
Figure 8G:
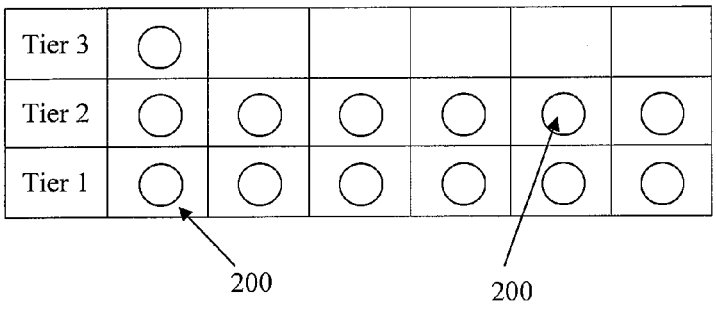
Figure 8H:
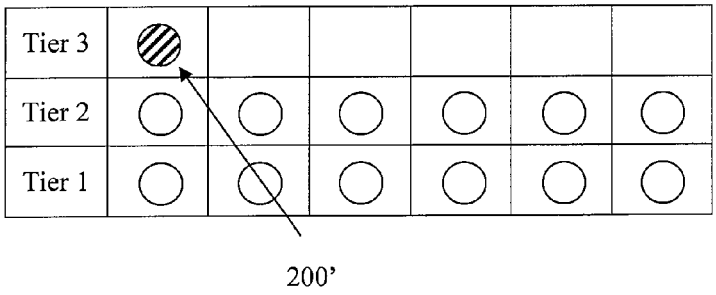

Another embodiment of a gaming system 700 is displayed in FIG. 7. In such embodiments, the system comprises a plurality of gaming devices 710*a,b*, such as the free standing and/or handheld gaming devices described herein with reference to FIGS. 1*a* and 1*b*. Each gaming device has its own controller (not shown) which operates an individual time eligibility counter 770*a,b* for such gaming device 710*a,b*. The time eligibility counters 710*a,b* include multiplier levels, and are incremented during play of the primary wagering game. Thus, as a lower level of time eligibility is filled, the multiplier level is increased, and time eligibility on a higher level begins to be incremented during play of the wagering game. Each gaming device 710*a,b* displays a primary wagering game 760*a,b*, as described herein. Moreover the system 700 may include a central controller 790 and external systems 792 in communication with the gaming devices 710*a,b*. The central controller 790 may serve to process requests and exchanges of information between and among the gaming devices 710*a,b*, and the external systems 792. The external systems 792 may include servers, network devices, memory storage, accounting components, peripherals, and other devices.

During operation of the system 700, the two gaming devices 710*a,b* operate independently. Thus, the first gaming device 710*a* includes its own controller (not shown) which operates the primary wagering game 760*a* displayed thereon, as well as the time eligibility meter 770*a* and the progressive jackpots 782*a*. Similarly, the second gaming device 710*b* includes its own controller (not shown) which operates the primary wagering game 760*b* displayed thereon, as well as the time eligibility meter 770*b* and the progressive jackpots 782*b* displayed thereon. Because the devices 710*a,b* are independent, the time eligibility meters 770*a,b* operate independently, and are incremented and decremented at different times based upon event occurring on the individual devices 710*a,b*. Similarly, the progressive jackpots 782*a* on the first device 710*a* are different than those on the second device 710*b*, and may be of different sizes, increment speeds, labels, themes, types, etc.

Each gaming device 710 operates individually to decrement its time eligibility meter 770. As each time eligibility meter 770 is decremented, one or more associated progressive jackpots 782 on that device 710 are incremented, as described herein with reference to FIG. 6. Thus, for example, for each ten seconds of decrementing of the time eligibility meter 770*a* on the first device 710*a*, one free spin is added to the progressive meters 782*a* on that device 710*a*. Similarly, for every twenty seconds of decrementing of the time eligibility meter 770*b* on the second device 710*b*, one free spin is added to the progressive meters 782*b* on that device 710*b*. As with the system of FIG. 6, a triggering event may cause an award of one or more of the progressive jackpots 782 on one or more of the devices 710*a,b* of the system. Jackpots 782*a,b* on separate devices 710*a,b* may be awarded simultaneously, separately, independently, or in any order or dependency. In this way, each device 710*a,b* operates independently to add time eligibility to the meters 770*a,b* based upon rate of play and size of wagers, decrement the meters 770*a,b* as time progresses, increment the progressive jackpots 782*a,b* based upon decay of the time eligibility meters 770*a,b*, randomly trigger a progressive jackpot 782*a,b* to be awarded, determine if a player of the associated gaming device 710*a,b* is eligible to receive the triggered jackpot 782*a,b*. If so, then the jackpot 782*a,b* triggered is awarded to such player.

As seen in FIG. 7, the time eligibility meters 770*a,b* of the two gaming devices 710*a,b* contain different balances. The first meter 770*a* has 40 seconds of eligibility at an 8.times. multiplier remaining. The second meter 770*b* has 72 seconds of eligibility at a 12.times. multiplier remaining. Moreover, the meters 770*a,b* are incremented at different rates, as indicated herein. In an embodiment, the meters 770*a,b* may be decremented at the same rate, or at different rates. However, it should be understood that each meter 770*a* serves its associated gaming device 710*a,b* and primary wagering game 770*a,b* independent of other gaming machines and devices on the system 700. In this way, each device 710*a,b* operates independently to increment and decrement the time eligibility meter 770*a,b*, increment the progressive jackpots 782*a,b* associated with the device 710*a,b*, and trigger jackpot awards.

The systems and methods described herein offer a number of benefits and advantages over traditional gaming systems. By utilizing a random determination process as described herein, progressive jackpots may be incremented using only whole numbers, and creating an exciting anticipation as to whether or not progressive meters will increment on each play of the game. Furthermore, a decay or decrementing of a time eligibility meter may be utilized to increment one or more progressive jackpots of a gaming system to provide additional excitement and anticipation. For example, a player may watch as progressive meters increment even though he or she is not actively playing a primary wagering game, but rather just through decay of a time eligibility meter. Moreover, the systems described herein permit a freestanding gaming device to operate independently to provide one or more progressive meters which are incremented and awarded independently of other gaming devices.

In accord with at least some aspects of the present concepts, a n-th unit game feature is disclosed wherein a wager amount is used to determine a plurality of discrete units that are consumed or utilized over time and wherein each of the discrete units provides eligibility for one or more game features upon utilization. In one aspect, the n-th unit game feature may be considered an n-th coin game feature in which each coin input corresponds to a separate unit (e.g., a 4-coin wager would produce 4 discrete units, a 5-coin wager would produce 5 discrete units, a n-th coin wager would produce n-th discrete units). It is to be understood, however, the term "coin" is used herein as a general term to denote not only coins, but to denote value in general. Wagering games now typically do not receive or output coins and, rather, wagers are placed and prizes awarded in terms of credits. Each credit is usually valued at the minimum bet (or denomination) of the game (e.g., penny, 2 pennies, nickel, dime, etc.). Thus, is a 5 cent game, a one credit bet is worth 5 cents. Thus, as used herein, the term "coin" is to be understood to likewise represent credits or other medium of exchange of value.

Contrary to a typical wagering game, wherein eligibility is typically conferred by a minimum wager and a subsequent line pay and/or or a determination made at the time of the input of a wager, the present aspects evaluate discrete units over time to determine if an eligibility requirement has been satisfied to thereby trigger one or more game features (e.g., an interactive game feature, a non-interactive game feature, free spins, etc.). The present concepts utilize n-th discrete units over time and each of the n-th discrete units is separately evaluated against an eligibility requirement or trigger. The n-th discrete units may be, for example, actual monetary values amounts (e.g., a fraction of a penny, a fractional number of pennies, a whole number of pennies, a fraction of a dollar, a fractional number of dollars, a whole number of dollars, etc.), units of time (e.g., a fraction of a second, one or more seconds, etc.), or some other discrete unit of any form that can be incremented and decremented over time.

In the context of a progressive wagering game having an n-th coin threshold, a conventional approach would be to immediately adding any wager or required progressive contribution relating thereto to the N-th coin threshold. By definition, the evaluation of the threshold occurs synchronously, during wagering game play. In contrast, in accord with the present concepts, the wager or required contribution is banked, divided into discrete eligibility units, and contributed either one coin at a time or in subsets (e.g., clumps of multiple discrete eligibility units) in a round-robin fashion, or other manner, or from all wagering game machines to the threshold every fixed interval of time (for example every second) at the portal server. Once the N-th coin has been contributed to satisfy or exceed the threshold, the contributing wagering game machine is identified and any win displayed and the progressive win is awarded to the wagering game machine, even if the threshold is satisfied by the contributing wagering game machine asynchronously (i.e outside of a spin or after conclusion of a wagering game and prior to subsequent play of wagering game). Thus, in accord with the present concepts, the discretizing and stretching out of the eligibility afforded by the wager contributions enable the n-th unit to be contributed to the threshold at any point during the triggering wagering game machine's spin and even outside of the triggering wagering game machine's spin.

In accord with the present concepts, the win display in association with the wagering game progressive game (e.g., n-th coin progressive), group game, or other gaming event is not necessarily limited to only those wagering game machines that are currently in a spin at the time the n-th coin is contributed as are conventional gaming systems (i.e., in conventional systems, if a wagering game machine isn't in a spin then that wagering game machine has a zero chance of winning the progressive and pausing play of a wagering game machine that is not eligible for the progressive to participate in the win display is disruptive. Thus, in accord with the present concepts, wagering game machines are permitted, based on the availability of non-utilized discrete units of eligibility, to participate in the game feature (e.g., have one or more chances to win a progressive game) regardless of whether or not they are actually in a spin or between spins. As one benefit, for the WMS GAMING® UHP (ULTRA HIT PROGRESSIVE®) series of wagering games (e.g., JACKPOT EXPLOSION®, PIGGY BANKIN'®, etc.), this innovation permits more bank-wide win shows that are more immersive than usual since the bases games of all of the wagering game machines on the bank can be paused for the win show, in which portal does not have to compete for graphic or CPU resources.

To illustrate, the ULTRA HIT PROGRESSIVE® portal application of WMS GAMING® is a mystery triggered, multi-level progressive providing a secondary bonus opportunity. As coin-in increases via participating wagering game machines, the Jackpot Explosion theme is visually represented by a giant volcano whose lava rises to the top of the volcano in the top screen and a sea of lava behind mechanical or video reels, with the sea of lava rising behind the reels as coin-in increases. After a certain amount of turnover, where turnover is a function of the probability for each award and the strike price, a progressive award win will hit. In an example wherein a random trigger is $100.00, at $99.99 the next wagering game machine to register an $0.01 input will cross the threshold and set off a progressive win. When the progressive triggers, the volcano explodes in a shower of coins as 1 of 4 progressive jackpots is randomly awarded to an eligible player. During the win show, with the exploding of the volcano and showering down of lava and coins on the secondary display(s) and/or primary display(s), the winner of the progressive (e.g., the player of the wagering game machine that triggered the progressive win) may not immediately be apparent. Including non-active wagering game machines (e.g., wagering game machines that are between spins) will provide a better player experience for players playing on the bank of wagering game machines at least in that non-active wagering game machines can also trigger and win the progressive and will provide a better bank-wide presentation to attract players to the bank.

As noted above, a n-th unit game feature is provided in which a wager amount is used to determine a plurality of discrete eligibility units that are consumed or utilized over time and wherein each of the discrete eligibility units provides eligibility for a game feature, or one or more game features, upon utilization. Thus, the eligibility conferred by the wager is discretized and spread out over a period of time, rather than being utilized in a single instance. In accord with the present concepts, there is flexibility in both the number of discrete eligibility units that are associated with each unit of wager or a predetermined wager amount(s) as well as with a utilization rate of such discrete eligibility units. In operation, a player inputs wagers and each wager amount is used to determine a number of discrete eligibility units to be provided to the player. As the player plays the wagering game, the available number of the discrete eligibility units decreases over time as they are utilized, and each additional wager by the player again adds to the available number of the discrete eligibility units. For example, where the discrete eligibility units are represented by units of time, a wager of 20 credits could yield 20 discrete units, a wager of 30 credits could yield 30 discrete units, and a wager of 40 credits could yield 40 discrete units. It is expected that as a player maintains a constant rate of wagering and play, the available number of the discrete eligibility units would generally fall within a steady state range.

In some aspects of the present concepts, the number of discrete eligibility units is proportional to the input wager. In other aspects of the present concepts, the number of discrete eligibility units is not proportional to the input wager and may, for example, be weighted to provide greater numbers of discrete eligibility units for higher wager amounts.

Separate and apart from a proportional relationship between a number of discrete eligibility units and an input wager, or an optional variation in the number of discrete eligibility units associated with wagers of various amounts, the value assigned to each of the discrete eligibility units or the utilization rate(s) of the discrete eligibility units may optionally (1) be fixed, (2) vary over time, (3) vary in accord with a predetermined tier or level, (4) be enhanced by non-wager inputs.

In a simple example, a utilization rate of the discrete eligibility units is fixed. For example, in a game where the duration of the reels spinning before stopping to reveal the outcome is 2 seconds, each input coin may be associated with two discrete eligibility units so that a wager of 5 coins would confer ten discrete eligibility units. If the utilization rate is one discrete eligibility unit every 0.35 seconds, the player would enjoy 3.5 seconds of eligibility for the 5 coin wager, which would then confer 1.5 seconds of remaining eligibility after the end of the wagering game and prior to the player's start of another wagering game. In this example, the discrete eligibility units themselves are not associated with a duration or time, and are simply present for utilization by the game controller in determining eligibility. In another example wherein the game feature is a multi-level progressive with a mystery trigger, for each coin (e.g., $0.25) wagered, one cent is set aside as a discrete eligibility unit, so that a wager of five coins would convey five cents set aside as five discrete eligibility units. Rather than all five cents being submitted at once to a wagering game controller to determine if the five cents contributed to a progressive pool counter by the wagering game machine was sufficient to cross the threshold of the mystery trigger (e.g., causing a $99.96 pool to flip over a $100.00 trigger), the five cents would be separately apportioned so that only one cent would be utilized at a time to determine whether or not the threshold for the progressive win has been crossed. The game controller, in turn, would sample each wagering game machine in the bank of machines associated with the multi-level progressive in round robin fashion at a fixed interval (e.g., every 0.5 seconds, every second, etc.) to receive each one cent increment before starting over to receive the next one cent increment. Thus, the contribution to the progressive pool is spread out over time for each wagering game machine.

In at least some aspects of the present concepts, the eligibility units are permitted to vary over time. By way of example, if a player is able to maintain one or more eligibility units in play for an extended period of time (e.g., playing at a high rate with high wagers so as not to deplete the one or more eligibility units for a predetermined time) the one or more eligibility units may convert into eligibility units having greater amounts of eligibility (e.g., 1.0 seconds rather than a lesser base amount of time).

In another example, the discrete eligibility units vary in accord with a predetermined tier or level, wherein a first tier (e.g., the easiest to fill) provides 0.7 seconds of eligibility per discrete eligibility unit, whereas a second tier entered once a player accumulates a first predetermined number of discrete eligibility units in the first tier (e.g., 2, 3, 4, 5, etc.) provides a different eligibility (e.g., higher or lower) per discrete eligibility unit. Thus, for example, a second tier discrete eligibility unit provides, continuing with the above example, 1.0 seconds per discrete eligibility unit (i.e., higher than that of the first tier) or, alternatively, 0.5 seconds per discrete eligibility unit (i.e., lower than that of the first tier). Correspondingly, a third tier entered once a player accumulates a second predetermined number of discrete eligibility units in the second tier (e.g., 2, 3, 4, 5, etc.) can provide still a different eligibility (e.g., higher or lower) per discrete eligibility unit. Thus, the discrete eligibility units are able to be adapted to provide a selected game dynamic. Correspondingly, rather than adjusting a value for one or more discrete eligibility units, a utilization rate may be altered so that the rate at which one or more discrete eligibility units at a wagering game terminal are treated differently than other discrete eligibility units at the wagering game terminal or so that the rate at which one or more discrete eligibility units at a wagering game terminal are treated differently than one or more discrete eligibility units at another wagering game terminal.

Further, in various non-limiting aspects, the utilization rate(s) of the discrete eligibility units may be (1) fixed, (2) configured to vary over time, (3) configured to vary in accord with a predetermined tier or level, or (4) enhanced by non-wager inputs. In the simplest example, a utilization rate of the discrete eligibility units or a value (e.g., time) attributed to one or more of the eligibility units may be enhanced by something other than the addition of a wager and, instead, may be enhanced, for example, by a wagering game outcome, a triggering condition in a wagering game, a consolation prize, or random event. By way of example, a predetermined non-winning outcome(s) in the wagering game (e.g., no winning amount specified in the paytable) or winning outcome(s) may convey additional discrete eligibility units.

It is further to be noted that the allocation of the discrete eligibility units optionally may vary non-linearly in correspondence with the input wager amount. For example, a higher wager may provide a disproportionately higher number of discrete eligibility units than a lesser wager. In one example, using the example above of the multi-level progressive with a mystery trigger, for a first coin (e.g., $0.25) wagered one cent is set aside as a discrete eligibility unit, for a second coin wagered two cents are set aside as discrete eligibility units, for a third coin wagered four cents are set aside as discrete eligibility units, for a fourth coin wagered six cents are set aside as discrete eligibility units, and for a fifth coin wagered 10 cents are set aside as discrete eligibility units. In this manner, players who place greater wagers will have more chances to win the multi-level progressive than players placing comparatively lesser wagers, where the rate of play is itself taken to be equal. Likewise, in lieu of a non-linear allocation of the discrete eligibility units in correspondence with the input wager amount, characteristics of the discrete eligibility units (e.g., decay-rate, sampling rate, etc.) may vary non-linearly in correspondence with the input wager amount.

For example, a higher wager may provide discrete eligibility units conveying eligibility for one or more game features upon utilization wherein the presence of such discrete eligibility units themselves convey eligibility for the one or more game features and wherein one or more of the discrete eligibility units for higher wager amounts last for a greater period of time than discrete eligibility units of lesser wager amounts. In one example, using the example above of the multi-level progressive with a mystery trigger, each of a first coin through a third coin have a first time-based discrete eligibility unit associated therewith, wherein the duration of existence of the first time-based discrete eligibility unit corresponds to a frequency of sampling of the gaming machines by the game controller in assessing eligibility for the one or more game features. A fourth coin, however, provides a second time-based discrete eligibility unit having a duration of existence greater than that of the first base-line time-based discrete eligibility unit (e.g., a multiple thereof) so that the second time-based discrete eligibility unit is retained for a duration that corresponds to a multiple of a frequency of sampling of the gaming machines by the game controller in assessing eligibility for the one or more game features Likewise, a fifth coin provides a third time-based discrete eligibility unit having a duration of existence greater than that of the first and/or second time-based discrete eligibility unit (e.g., a multiple thereof) so that the third time-based discrete eligibility unit is retained for a duration that corresponds to a greater multiple of a frequency of sampling of the gaming machines by the game controller than that of the second time-based discrete eligibility unit.

In accord with the above aspects, players who place greater wagers are provided with greater opportunity for achieving eligibility for the one or more game features (e.g., bonus game, community event game, progressive award, etc.), whether by greater numbers of opportunities for consideration for eligibility, greater duration of eligibility, or both. It is not necessary for the game controller to consider only a single discrete eligibility unit at one time and it is possible for the game controller to consider a plurality of discrete eligibility units at one time and a remainder of the discrete eligibility units at another time or at a plurality of subsequent times. In one example, for a given wager, a first percentage of a first portion of the discrete eligibility units are aggregated and utilized all at once in a first eligibility period by the game controller, whereas a second percentage of a second portion of the discrete eligibility units are used in a second eligibility period by the game controller. The first eligibility period could comprise one or more times during which the game controller utilizes the first portion of the discrete eligibility units to determine eligibility and the second eligibility period could comprise one or more times during which the game controller utilizes the second portion of the discrete eligibility units to determine eligibility. By way of example, a set of 100 discrete eligibility units could be divided into a first portion of 50 discrete eligibility units that are utilized by the game controller in the first second of wagering game play and 50 discrete eligibility units that are utilized by the game controller during the remainder of wagering game play (e.g., the subsequent second or two) and subsequent to the end of the wagering game.

FIGS. 8(*a*)-8(*h*) show successive illustrations showing an example of at least some of the above-noted aspects, wherein a n-th unit game feature is provided in which a wager amount is used to determine a plurality of discrete eligibility units that are consumed or utilized over time and wherein each of the discrete eligibility units provides eligibility for a game feature, or one or more game features, upon utilization. As noted above, in operation, as the player inputs wager, each wager amount is used to determine a number of discrete eligibility units to be provided to the player and, as the player plays the wagering game, the available number of the discrete eligibility units decreases over time as they are utilized. For example, if an average spin is 3 seconds and a 40 coin wager provides 10 second of eligibility (e.g., 10 discrete eligibility units of 1 second, 40 discrete eligibility units of 0.25 seconds, 80 discrete eligibility units of 0.125 seconds, etc.), a single large wager provides eligibility for one or more game features for a period of 7 seconds following completion of the wagering game. So long as a player inputs the same wager at a rate of at least once every 10 seconds, the player would enjoy continued eligibility for the one or more game features even though the player is not engaged in a wagering game at the time of the game controller's consideration of the player's eligibility. For illustrative purposes, the discrete eligibility units are represented in FIGS. 8(*a*)-8(*h*) as circles 200, which can represent, for example, a monetary value to be added to a progressive pool or award pool (i.e., a monetary amount), a unit of time, or other discrete aspect of eligibility.

FIG. 8(*a*) represents a state prior to initiation of wagering game play wherein no discrete eligibility units have yet been accumulated by a player's wager. In this example, for simplicity of illustration, it will be assumed in this example that the wager is a five coin wager and the eligibility is for a progressive prize with a mystery trigger, with a percentage of each coin being set aside for eligibility determination for the progressive prize and, to such end, being further subdivided into discrete eligibility units 200, represented as a circle or coin.

Three tiers of discrete eligibility units are shown (tier 1, tier 2, tier 3), with each tier being divided into 6 subparts. The states represented in FIGS. 8(*a*)-8(*h*) reflect data structures in accord with the present concepts wherein a physical memory operatively associated with the wagering game machine or wagering game system maintains a tally of the discrete eligibility units, such tally optionally being displayed to a player. The depicted number of rows and columns are not to be construed as limiting in any way and the present concepts include any number of, and number of types of, discrete eligibility units 200. Further, in accord with the present concepts, the tiers may be indistinct, with each of the discrete eligibility units being the same regardless of tier, or there may simply be a single tier. Alternatively, the tiers may be distinct, with higher level tiers conferring an advantage or benefit (possibly with an attendant detriment as well), consistent with the underlying wagering game mathematics of the one or more game features to which the discrete eligibility units relate, relative to discrete eligibility units in one or more lower level tiers below. For example, a discrete eligibility unit in a higher tier may confer a greater number of chances to satisfy the eligibility requirement, or a greater likelihood of satisfying the eligibility requirement, during an evaluation cycle than a discrete eligibility unit in a lower tier. As to the noted potential detriment, as one example, a discrete eligibility unit in a higher tier may last shorter, time-wise, than a discrete eligibility unit in a lower tier so as to mathematically balance potential enhanced benefits associated with the higher tier with generally corresponding detriments.

In operation, for the representative example of FIGS. 8(*a*)-8(*h*), the game controller separately adds the discrete eligibility units 200 to the progressive pool, rather than the standard percentage of each coin, to iteratively see if the threshold is crossed. FIG. 8(*b*) represents a state following input of the wager and during wagering game play, but prior to conclusion of play of that specific wagering game, with five discrete eligibility units being shown to have been accumulated by a player's wager. FIG. 8(*c*) represents a state following that of FIG. 8(*b*), which could occur during wagering game play (e.g., prior to conclusion of play of that specific wagering game) or could occur even after completion of the wagering game in accord with aspects of the present concepts. In the case of FIG. 8(*c*), the right-most discrete eligibility unit 200' is shown with cross-hatched lines, representing that that discrete eligibility unit 200' is in the process of being utilized by the game controller to determine if that particular discrete eligibility unit 200' confers actual eligibility to the player of the wagering game for the progressive prize. Stated differently, for this example, the value associated with the discrete eligibility unit 200' is added to the progressive pool and the game controller determines whether that discrete addition caused the mystery trigger to be exceeded. If the threshold is not exceeded, the game controller goes on to another gaming machine in the bank and performs the same operation, repeating this process over and over at various gaming machines until such time as one discrete eligibility unit 200' at one gaming machine is added to the progressive pool and, in so doing, causes the mystery trigger to be exceeded. In accord with the present concepts, the game controller is not required to sample or evaluate the wagering game machines in any particular order and the game controller may evaluate the set of wagering game machines sequentially, randomly (e.g., in a shuffled order until all wagering game machines have been evaluated), or the like.

FIG. 8(*d*) shows a state wherein the discrete eligibility unit 200' from FIG. 8(*c*) is now gone, as the game controller has utilized and removed such discrete eligibility unit, leaving four discrete eligibility units 200 remaining at the depicted moment which, again, could be during play of a wagering game or following completion of a wagering game. FIG. 8(*e*) shows a point in time where additional discrete eligibility units 200 have been added by an input of another wager to play another wagering game. From FIG. 8(*d*), FIG. 8(*e*) can be seen to show the addition of two additional discrete eligibility units 200 to fill up tier 1, and three additional discrete eligibility units 200 allocated to tier 2.

FIG. 8(*f*) represents a state following that of FIG. 8(*e*) which, as noted above, could occur during wagering game play (e.g., prior to conclusion of play of that specific wagering game) or could occur even after completion of the wagering game in accord with aspects of the present concepts. FIG. 8(*f*) shows the right-most discrete eligibility unit 200' in the process of being utilized by the game controller to determine if that particular discrete eligibility unit 200' confers actual eligibility to the player of the wagering game for the progressive prize. Again, in the present example, the value associated with the discrete eligibility unit 200' is added to the progressive pool and the game controller determines whether that discrete addition caused the mystery trigger to be exceeded.

FIG. 8(*g*) shows a point in time where additional discrete eligibility units 200 have been added by an input of another wager to play another wagering game. From FIG. 8(*f*), FIG. 8(*g*) can be seen to show the addition of four additional discrete eligibility units 200 to fill up tier 2, and one additional discrete eligibility unit 200 allocated to tier 3. FIG. 8(*h*) represents a state following that of FIG. 8(*g*) which, as noted above, could occur during wagering game play (e.g., prior to conclusion of play of that specific wagering game) or could occur even after completion of the wagering game in accord with aspects of the present concepts. FIG. 8(*h*) shows the sole discrete eligibility unit 200' in tier 3 in the process of being utilized by the game controller to determine if that particular discrete eligibility unit 200' confers actual eligibility to the player of the wagering game for the progressive prize.

Of course, although the illustrative example above in FIGS. 8(*a*)-8(*h*) was discussed in reference to discrete eligibility units 200 that were correlated to a monetary value (e.g., a percentage of each coin's value), each of the discrete eligibility units 200 could represent any monetary value or could, more generically, represent any discrete eligibility unit, such as a five coin wager yielding 5 dimensionless units (e.g., a "0" or "1") or 5 voltage values (e.g., five binary "on" states in a physical memory) against which an eligibility is assessed by the game controller and, following such assessment by the game controller, the state of a respective one or more of the dimensionless units are changed to eliminate the discrete eligibility unit from further consideration (e.g., a binary "on" state is changed to a binary "off" state).

It is to be noted, however, that discrete eligibility units 200 may optionally be obtained through alternative avenues in accord with at least some aspects of the present concepts and could include, but not limited to, an award associated with an outcome in a wagering game or separate purchase by a player through a gaming establishment employee or an exchange, computer, kiosk, portable electronic device (e.g., cell phone) or wagering game machine.

It is to be noted that the present concepts permit arrangement of the discrete eligibility units in any manner. As shown in the current example, tier one is filled before discrete eligibility units are placed in tier 2, and so on. In one exemplary alternative configuration, first column positions are filled before second column positions are filled such that a first position in each of tier 1, tier 2 and tier 3 are filled before the tier 1 position in the second column is filled with a discrete eligibility unit 200. In this regard, it is to be noted that the bottom of the depicted matrix may, in at least some aspects, reflect a time axis wherein each of the discrete eligibility units in a column are all evaluated by the game controller at the same increment of time. By way of example and with reference to FIG. 8(*e*), in such a configuration, at a time of $T_0$ (e.g., represented by the first column in FIG. 8(*e*)), two discrete eligibility units 200 are utilized by the game controller to determine eligibility, one from tier 1 and one from tier 2. Continuing the example, at each of times of $T_1$ and $T_2$ (e.g., represented by the second and third column in FIG. 8(*e*), respectively), two discrete eligibility units 200 are again utilized by the game controller to determine eligibility, one from tier 1 and one from tier 2, whereas at each of times of $T_3$ and $T_4$ (e.g., represented by the fourth and fifth column in FIG. 8(*e*), respectively), one discrete eligibility unit 200 from tier 1 is utilized by the game controller to determine eligibility. Thus, the present concepts permit the discrete eligibility units 200 to be logically arranged and evaluated differently over successive game controller cycles. Continuing with the present example, the game controller evaluates two discrete eligibility units 200 at time $T_2$ (e.g., represented by the third column in FIG. 8(*e*)), but only one discrete eligibility unit 200 at the next evaluation time $T_3$ (e.g., represented by the fourth column in FIG. 8(*e*)).

In the example shown in FIGS. 8(*a*)-8(*h*), the addition of discrete eligibility units 200 was performed in a sequential manner, with the discrete eligibility units 200 filling the matrix of columns and tiers in a predetermined sequence. Alternatively, the population of one or more tiers, such as tier 2 or tier 3, for example, may be random, so that an individual discrete eligibility unit 200 may be assigned to any available position (e.g., column) along a tier.

Further, in at least some aspects of the present concepts, via gameplay, the profile of the discrete eligibility units 200 may dynamically change during or after conclusion of a wagering game as a direct result of an outcome during wagering game play (e.g., an appearance of one or more predetermined symbols, etc.). Using the example of FIG. 8(*e*), the three discrete eligibility units in the rightmost three columns of tier 1 could be moved into the first three columns of tier 3 so as to effectively increase volatility and improve the short-term odds of achieving eligibility. Still further, in at least some aspects of the present concepts, via player-input before, during or after wagering game play, a player may choose to select a desired profile, or alter a current profile, of the discrete eligibility units 200 to thereby permit the player to select their own desired volatility. The player input may comprise a touch screen display, key-pad, GUI interface, slider, or other input device. A wagering game device or system in accord with such aspects would advantageously permit a player to select from amongst a plurality of defined profiles of discrete eligibility units 200 to, for example, weight discrete eligibility units 200 toward comparatively earlier points in the game controller evaluation cycle (e.g., to utilize more discrete eligibility units 200 more quickly), rather than weighting such discrete eligibility units 200 evenly or more toward comparatively later points in the game controller evaluation cycle (e.g., to utilize discrete eligibility units 200 over a longer period of time, such as to encompass time periods subsequent to completion of wagering game play).

It is again to be noted, however, that in other aspects of the present concepts a value associated with a discrete eligibility unit may be subtracted from a counter relating to the mystery trigger and the game controller determines whether that discrete subtraction caused the counter to fall below another threshold amount (e.g., counting down to zero). Thus, the example of FIGS. 8(*a*)-8(*h*) may alternatively set a mystery threshold and count down from the mystery threshold to a predetermined set-point (e.g., zero), subtracting the discrete eligibility units therefrom to arrive at or exceed the set-point, at which point the n-th unit prize is awarded.

Figure 9:
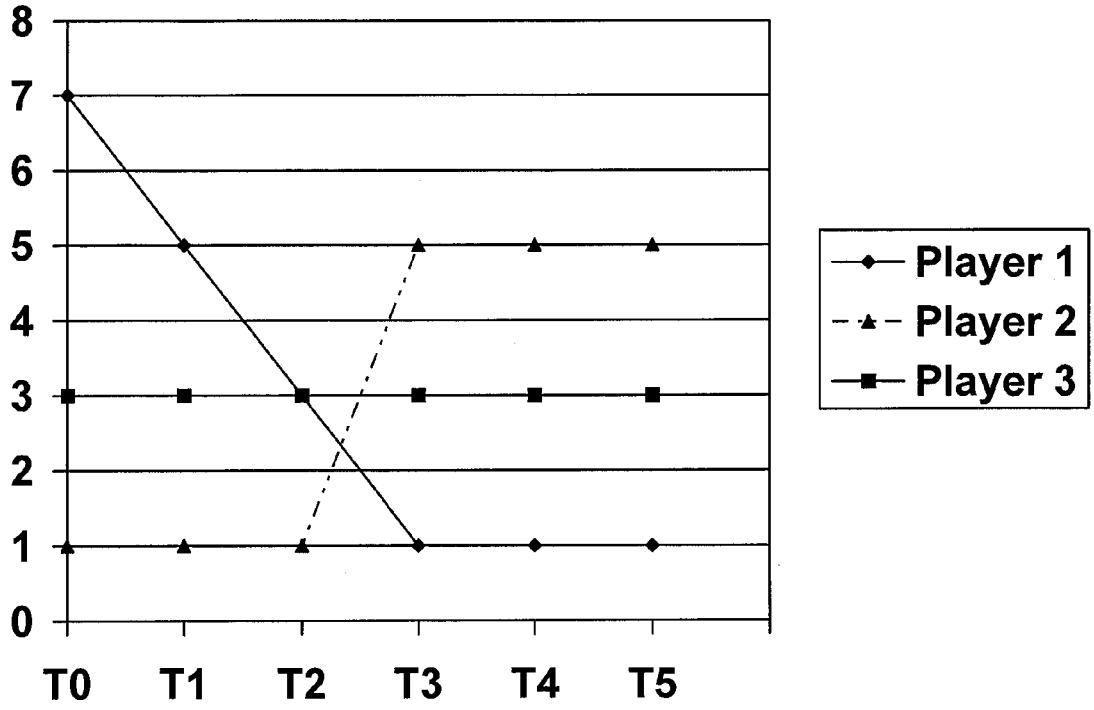
FIG. 9 shows examples of a player-configurable profile for utilization of accumulated discrete eligibility units in accord with at least some aspects of the present concepts.

FIG. 9 shows an example wherein three different players (player 1, player 2, player 3) each select different profiles for utilization of accumulated discrete eligibility units 200. Similar to the example of FIGS. 8(*a*)-8(*h*), the discrete eligibility units 200 are able to be distributed, in this example, over 6 possible time increments T0-T5, where each time increment represents an evaluation cycle by the game controller. Each time increment could be measured in any time period such as, but not limited to, milliseconds or seconds. Player one has selected a discrete eligibility unit utilization profile that weighs the accumulated discrete eligibility units 200 toward relatively earlier time increments. In other words, a greater number of discrete eligibility units 200 are utilized in time increments T0-T2 than are used in successive time increments T3-T5. In contrast, player 2 has selected a discrete eligibility unit utilization profile that weighs the accumulated discrete eligibility units 200 toward relatively later time increments. In other words, a greater number of discrete eligibility units 200 are utilized in time increments T3-T5 than are used in prior time increments T0-T2. In this manner, player two enhances the probability of achieving eligibility for a prize or feature at the end of, or following, wagering game play. Player 3, on the other hand, has selected a discrete eligibility unit utilization profile that evenly weighs the accumulated discrete eligibility units 200 across time increments T0-T5.

Although the example of FIGS. 8(*a*)-8(*h*) focused on an exemplary progressive feature, the embodiment described with respect thereto more broadly relates to any prize (e.g., lump sum jackpot, etc.) triggered on an n-th coin, and still more broadly to any game feature (e.g., free spins, game event, etc.) triggered on an n-th coin wherein, instead of such prize or feature being triggered by a pay line outcome, such prize or feature is triggered by utilization of the discrete eligibility units 200. As one example, the game feature could comprise a bonus game having a theoretical average of expected value (EV) that is equal to the value of the mystery trigger.

Each of these embodiments and obvious variations thereof is contemplated as falling within the spirit and scope of the claimed invention, which is set forth in the following claims. For example, although the aforementioned examples generally related to an example in which a counter was incremented upwardly, from zero value or pre-determined non-zero value starting point, toward a n-th unit prize pool threshold trigger, the present concepts also apply to embodiments wherein a counter is incremented downwardly from a n-th unit prize pool threshold trigger toward a zero value or toward another pre-determined non-zero value (e.g., counting down to zero).

The invention claimed is:

1. A wagering game system comprising:

a game controller;

a physical memory operatively coupled to the game controller; and a wagering game machine, comprising a display device, communicatively coupled to the game controller, wherein the game controller is operatively configured to perform acts comprising:

determining a mystery threshold trigger level for an n-th unit prize and setting a threshold trigger level counter to an initial value;

discretizing an input wager into a plurality of discrete eligibility units;

adding the plurality of discrete eligibility units to a discrete eligibility units counter for the wagering game machine;

subtracting periodically a discrete eligibility unit from the discrete eligibility units counter and correspondingly incrementing the threshold trigger level counter;

determining whether the discrete eligibility unit used to increment the threshold trigger level counter triggers the n-th unit prize;

triggering the n-th unit prize if the threshold trigger level counter meets or exceeds the threshold trigger level or if the threshold trigger level counter meets or exceeds another predetermined value relative to the threshold trigger level; and awarding the n-th unit prize responsive to the act of triggering or, absent such triggering, iteratively performing at least the acts of subtracting and determining until no discrete eligibility units remain in the discrete eligibility units counter.

2. The wagering game system according to claim 1, wherein subsequent to the acts of triggering and awarding, remaining discrete eligibility units in the discrete eligibility units counter are subtracted periodically and incremented relative to another n-th unit prize pool.

3. The wagering game system according to claim 2, wherein the initial value of the threshold trigger level counter is the mystery threshold trigger level and wherein the incrementing of the threshold trigger level counter in correspondence with the subtracting of the discrete eligibility unit from the discrete eligibility units counter comprises incrementing the threshold trigger level counter downwardly from the initial value to said another predetermined value relative to the threshold trigger level.

4. The wagering game system according to claim 1, wherein the n-th unit prize comprises a progressive award, an interactive game feature or a non-interactive game feature.

5. The wagering game system according to claim 1, wherein the game controller is further operatively configured to perform acts comprising:

determining another mystery threshold trigger level for another n-th unit prize following the awarding of the n-th unit prize and setting the threshold trigger level counter to an initial value;

discretizing an input wager into a plurality of discrete eligibility units;

adding the plurality of discrete eligibility units to the discrete eligibility units counter for the wagering game machine;

subtracting periodically a discrete eligibility unit from the discrete eligibility units counter and correspondingly incrementing the threshold trigger level counter;

determining whether the discrete eligibility unit used to increment the threshold trigger level counter triggers the n-th unit prize;

triggering the another n-th unit prize if the threshold trigger level counter meets or exceeds the threshold trigger level or if the threshold trigger level counter meets or exceeds another predetermined value relative to the threshold trigger level; and awarding the another n-th unit prize responsive to the act of triggering or, absent such triggering, iteratively performing at least the acts of subtracting, incrementing and determining until no discrete eligibility units remain in the discrete eligibility units counter.

6. The wagering game system according to claim 1, further comprising:

a plurality of wagering game machines, each of the plurality of wagering game machines being communicatively coupled to the game controller, wherein the game controller is operatively configured to perform acts comprising:

determining a mystery threshold trigger level for the n-th unit prize and setting the threshold trigger level counter to the initial value;

discretizing, for each of the plurality of wagering game machines, an input wager into a plurality of discrete eligibility units;

adding, for each of the plurality of wagering game machines, the plurality of discrete eligibility units to a discrete eligibility units counter for the respective wagering game machine;

subtracting a discrete eligibility unit from a discrete eligibility units counter at a selected one of the plurality of wagering game machines and correspondingly incrementing the threshold trigger level counter;

determining whether the discrete eligibility unit used to increment the threshold trigger level counter triggers the n-th unit prize;

triggering the n-th unit prize if the threshold trigger level counter meets or exceeds the threshold trigger level or if the threshold trigger level counter meets or exceeds another predetermined value relative to the threshold trigger level or, absent such triggering, iteratively performing at least the acts of subtracting, incrementing and determining at others of the plurality of wagering game machines until no discrete eligibility units remain in the discrete eligibility units counter of the respective wagering game machines or until a discrete eligibility unit subtracted from one of the plurality of wagering game machines and incremented into the threshold trigger level counter is determined to meet or exceed the threshold trigger level or said another predetermined value relative thereto; and awarding the n-th unit prize responsive to the act of triggering.

7. The wagering game system according to claim 6, wherein the initial value of the threshold trigger level counter is the mystery threshold trigger level and wherein the incrementing of the threshold trigger level counter in correspondence with the subtracting of the discrete eligibility unit from the discrete eligibility units counter comprises incrementing the threshold trigger level counter downwardly from the initial value to said another predetermined value relative to the threshold trigger level.

8. The wagering game system according to claim 1, wherein each of the discrete eligibility units are assigned a monetary value.

9. The wagering game system according to claim 1, wherein the act of evaluating the discrete eligibility unit against the threshold trigger level counter, threshold trigger level or said another predetermined value relative to the threshold trigger level occurs asynchronously.

10. The wagering game system according to claim 6, wherein the act of evaluating the discrete eligibility unit for a selected wagering game machine against the threshold trigger level counter, threshold trigger level or said another predetermined value relative to the threshold trigger level occurs asynchronously.

11. A method of conducting a wagering game of a wagering game system comprising a plurality of wagering game machines, the method comprising:

determining a mystery threshold trigger level for the n-th unit prize and setting the threshold trigger level counter to the initial value;

discretizing, for each of the plurality of wagering game machines, an input wager into a plurality of discrete eligibility units;

adding, for each of the plurality of wagering game machines, the plurality of discrete eligibility units to a discrete eligibility units counter for the respective wagering game machine;

subtracting a discrete eligibility unit from a discrete eligibility units counter at a selected one of the plurality of wagering game machines and correspondingly incrementing the threshold trigger level counter;

determining whether the discrete eligibility unit used to increment the threshold trigger level counter triggers the n-th unit prize;

iteratively selecting, absent triggering of the n-th unit prize, another one of the plurality of wagering game machines and repeating the acts of subtracting, incrementing, and determining, until the n-th unit prize is triggered; and awarding the n-th unit prize to a selected one of the plurality of wagering game machines that triggers the n-th unit prize.

12. The method of conducting a wagering game of a wagering game system according to claim 11, wherein the n-th unit prize comprises a progressive award or a fixed monetary prize.

13. The method of conducting a wagering game of a wagering game system according to claim 11, wherein each of the discrete eligibility units are assigned a monetary value.

14. The method of conducting a wagering game of a wagering game system according to claim 11, wherein the act of determining whether the discrete eligibility unit used to increment the threshold trigger level counter triggers the n-th unit prize occurs asynchronously.

15. The method of conducting a wagering game of a wagering game system according to claim 11, further comprising:

determining another mystery threshold trigger level for another n-th unit prize following the awarding of the n-th unit prize and setting the another threshold trigger level counter to an initial value;

discretizing an input wager from each wagering game machine into a plurality of discrete eligibility units;

adding the plurality of discrete eligibility units to a discrete eligibility units counter of a respective one of the plurality of wagering game machines;

selecting one of the plurality of wagering game machines;

subtracting a discrete eligibility unit from the discrete eligibility units counter of the selected one of the plurality of wagering game machines and correspondingly incrementing the another threshold trigger level counter;

determining whether the discrete eligibility unit used to increment the another threshold trigger level counter triggers the another n-th unit prize by meeting or exceeding the threshold trigger level or by meeting or exceeding another predetermined value relative to the threshold trigger level; and awarding the another n-th unit prize responsive to the act of triggering or, absent such triggering, iteratively performing at least the acts of subtracting, incrementing and determining until no discrete eligibility units remain in the discrete eligibility units counter.

16. A wagering game system comprising:

a game controller;

a physical memory operatively coupled to the game controller; and a wagering game machine, comprising a display device, communicatively coupled to the game controller, wherein the game controller is operatively configured to perform acts comprising:

determining an eligibility threshold trigger for an n-th unit prize;

adding a set of discrete eligibility units to a discrete eligibility units counter responsive to an input wager;

simultaneously evaluating a subset of the discrete eligibility units against the eligibility threshold trigger to determine if the eligibility threshold trigger is satisfied;

subtracting from the discrete eligibility units counter the subset of discrete eligibility units evaluated by the game controller against the eligibility threshold trigger;

awarding the n-th unit prize when a discrete eligibility unit satisfies the eligibility threshold trigger, and wherein the subset of the discrete eligibility units comprises a plurality of discrete eligibility units.

17. The wagering game system according to claim 16, wherein the n-th unit prize comprises a progressive award or a fixed monetary prize.

18. The wagering game system according to claim 16, wherein the n-th unit prize comprises a progressive award and wherein each of the discrete eligibility units are assigned a monetary value.

19. The wagering game system according to claim 16, wherein the game controller is further operatively configured to perform acts comprising displaying a representation of the discrete eligibility units counter on the display device of the wagering game machine.

20. The wagering game system according to claim 16, further comprising:

a player input device, operatively associated with the wagering game machine, configured to permit defining of a discrete eligibility unit utilization profile to change a distribution of the discrete eligibility units within the discrete eligibility units counter.

* * * * *